US005287883A

United States Patent [19]

Fink et al.

[11] Patent Number: 5,287,883

[45] Date of Patent: Feb. 22, 1994

[54] VALVE, IN PARTICULAR FOR COMPRESSORS

[75] Inventors: Günter Fink; Walter Hammerschmidt, Kinsau, both of Fed. Rep. of Germany

[73] Assignee: Hoerbiger Ventilwerke Aktiengesellschaft, Vienna, Austria

[21] Appl. No.: 955,458

[22] Filed: Oct. 2, 1992

[30] Foreign Application Priority Data

Oct. 2, 1991 [AT] Austria ..... 1976/91

[51] Int. Cl.[5] ..... F16K 15/08

[52] U.S. Cl. ..... 137/454.4; 29/512; 29/523; 29/890.13; 137/516.21

[58] Field of Search ..... 29/512, 523, 890.13; 137/516.11-516.23, 454.4

[56] References Cited

U.S. PATENT DOCUMENTS 3,082,512 3/1963 Scheldorf ..... 29/890.13 X
3,777,779 12/1973 Schwaller ..... 137/516.21 X
4,112,933 9/1978 Dey .

*Primary Examiner*—Robert G. Nilson

*Attorney, Agent, or Firm*—Watson, Cole, Grindle & Watson

[57] ABSTRACT

The riveting sleeve (6) described is used to connect the component parts (3, 4, 5, 10, 11) of compressor valves (2). The riveting sleeve (6) passes through the valve parts (3, 4, 5, 10, 11) to be connected to one another and is provided with at least one radial groove (16, 22, 26) which starts from the inner or outer generated surface (17, 18) thereof and weakens the wall thickness of the riveting sleeve (6) in this area. On the other side of the generated surface (17, 18) the groove (16, 22, 26) is adjacent either to the wall of a valve part surrounding it or surrounded thereby, or it has opposite it a recess (19, 23, 27) in the valve part (3, 5, 25) adjacent to the riveting sleeve (6). By upsetting the riveting sleeve (6) by means of an applied axial force, the riveting sleeve (6) is deformed radially outwards or inwards in the manner of a bead, it being securely clamped in or on the adjacent valve part. If a recess (19, 23, 27) opposite the respective groove (16, 22, 26) is provided, the said recess (19, 23, 27) is filled with the deforming material of the riveting sleeve (6) and in this way a secure and play-free connexion is produced.

7 Claims, 2 Drawing Sheets

VALVE, IN PARTICULAR FOR COMPRESSORS

Field of the invention

The invention relates to a valve, in particular for compressors, which can be inserted into or attached to a housing, for example a cylinder head, and can be clamped by at least one tensioning bolt against the seating face of the housing, the valve comprising a valve seating with through ducts, at least one closure member arranged movably above the latter, a catching means for the closure member and at least one spacer between the valve seating and the catching means.

BACKGROUND OF THE INVENTION

Description of prior art

As is known, in valve construction it is necessary in many cases to connect the constituent parts of the valves to one another. This is traditionally effected by screws or by means of deformable rivets which can also be heated to facilitate the deformation. Both types of connexion are relatively expensive or have other disadvantages. The screw connexions require machined threaded bolts and nuts, which in turn require space, whereas the simpler rivet connexions require for their manufacture the application of frequently substantial upsetting forces, as a result of which the valve parts resting thereon can be adversely affected. If the rivets are used in the heated state, the parts coming into contact with them can be damaged by the heating, for example with respect to the material hardness.

A valve with a central bolt for connecting the valve parts is known from AT-PS 242 281. The part of the central bolt, projecting beyond the catching means or the valve seating, and the associated nut require additional space in the cylinder head. Somewhat less space is required by the design according to U.S. Pat. No. 3,082,512, in which instead of the central bolt a hollow rivet is-used which is heated to red heat by way of electrodes and is then riveted by axial force accordingly. The valve parts can be damaged by the action of heat. Finally, in the case of the valve known from DE-OS 1 450 479 the valve parts are not provided with their own connexion. The component parts of the valves are pressed against the cylinder head of the compressor by a tensioning bolt passing through them. This design requires that the valve parts should be delivered loose and should be assembled only when attached to the compressor. In the process errors can occur, for example valve parts can be jammed between other component parts of the valve during clamping.

SUMMARY OF THE INVENTION

The invention is concerned with ensuring that the individual component parts of the valve are connected to one another and are inserted in the compressor in the correct insertion position. As is known, in many cases compressor manufacturers order the valves from specialist factories and then insert them into their compressors, for example by securing the valves to the cylinder head by tensioning bolts. In the case of conventional designs this makes it necessary for the compressor manufacturers to assemble the valves themselves during insertion into or attachment to the compressor itself. In this case it happens repeatedly that the valve parts are assembled incorrectly, which can lead to damage. A further disadvantage of delivering the valves as individual parts is that it is not readily possible for the valve manufacturer to conduct an operational test upon the unassembled valves before delivery.

The object of the invention is therefore to connect the valve parts to one another in a simple manner before insertion into the compressor.

This object is attained by the invention in that the valve parts are held securely on the valve seating or the catching means by at least one riveting sleeve acting as a transportation safeguard and assembly aid in addition to the tensioning bolt or bolts and before insertion or attachment of the valve into or to the housing of the compressor, the sleeve comprising at least one groove which starts from its inner or outer generated surface and which extends around its periphery, as a result of which the sleeve is deformable outwards or inwards in the region of the grooves by a force exerted upon it in the axial direction, and the riveting sleeve is connected by clamping to the external valve parts, in particular to the valve seating and the catching means, the other valve parts including a spacer provided in any case are fitted on the sleeve in the correct insertion position and the sleeve ends inside the valve parts or at most terminates flush with the outer face thereof.

The riveting sleeve provided according to the invention is therefore merely an assembly aid and a transportation safeguard which lies entirely inside the valve parts and therefore in no way obstructs the final fastening of the valve to its point of application, which is carried out by tensioning bolts passing through the riveting sleeves. The preassembly of the valve in the manufacturing works, provided for by the invention, first permits a simple operational testing thereof before delivery and, in addition, ensures that the component parts are not assembled incorrectly by the user of the valve who inserts it at the point of application.

In a further development of the invention a recess can be provided in the valve part adjacent to the riveting sleeve in the region of at least one groove on the side of the generated surface of the riveting sleeve opposite the groove. During the deformation of the riveting sleeve by the application of an axial force the material deformed in the manner of a bead in the region of the grooves is forced into the respective recess, fills it and thus produces a play-free connexion between the riveting sleeve and the valve parts, which is also tension-proof in the axial direction. If smaller stresses occur, however, smooth walls of the valve parts to be connected to one another are sufficient to produce a firm connexion, without recesses, in particular if the walls cooperating with the riveting sleeve are rough, for example by punching.

In accordance with a further feature of the invention a groove starting from the inner generated surface of the riveting sleeve can be provided in the region of one end of the said riveting sleeve and the valve part adjacent to the outside of the riveting sleeve can be widened into a funnel shape at the other end of the said riveting sleeve. In this connexion, the axial force for deforming the riveting sleeve is applied to that end of the riveting sleeve which is in the valve part widened into a funnel shape. In this way it becomes possible first for a deformation with a bead towards the outside to be produced in the region of the groove and thus for a play-free connexion to the adjacent valve part to be made, after which the end of the riveting sleeve present in the valve part widened into a funnel shape is enlarged radially into the funnel-shaped widening by further application of axial force. In this way, a play-free connexion—largely independent of tolerances—of the valve parts is achieved, additional centring and strengthening being achieved by the radial enlargement.

In the case of another variant of the invention, grooves can be provided in the region of the two ends of the riveting sleeve. In this way, the connexion to the adjacent valve parts is effected at both ends of the riveting sleeve by a bead-like enlargement of the riveting sleeve, a precisely defined, play-free connexion being achieved in the case of this embodiment as well, namely either merely by clamping or also by the bead-like protrusions filling the recesses—provided in any case—of the adjacent valve parts without play. On account of the shortening which occurs during the upsetting of the riveting sleeve the valve parts connected to one another are pressed against one another, so that a firm connexion is achieved in the axial direction as well.

Within the scope of the invention, the riveting sleeve can also have a plurality of grooves, wherein a plurality of valve parts can be connected together with a riveting sleeve. In this connexion, it is advantageous in the case of a riveting sleeve with more than one groove to make the grooves of unequal depth and/or unequal width. With this step it is possible, during the application of the axial force upon the riveting sleeve to make the connexion, for the individual areas provided with the grooves to be deformed not simultaneously but in succession, since in the case of a deeper or wider groove the remaining wall of the riveting sleeve is weaker and is thus deformed earlier as a result of the action of a smaller axial force than the wall in the region of a groove which is less deep or wide.

According to the invention an embodiment is preferred in which the depth or the width of the grooves is smallest at that end of the riveting sleeve, to which the axial force for riveting is applied, and increases stepwise towards the other end of the riveting sleeve. In this way it is possible to determine beforehand the sequence of the deformation of the areas of the riveting sleeve provided with grooves. The groove area most remote from the point of application of the axial force is deformed first, which ensures that a secure, play-free connexion which is also firm in the axial direction is achieved in all the deformed areas.

According to a further feature of the invention a tensioning bolt anchored in the cylinder head of a compressor can pass through at least one of the riveting sleeves in order to fasten the valve. In this connexion, the tensioning bolt is advantageously screwed through the riveting sleeve into a thread provided in a shouldered bore which also receives the riveting sleeve. Since only relatively small forces are required for the deformation of the riveting sleeve, there is no risk of the thread being damaged during the manufacture of the rivet connexion or during the deformation of the riveting sleeve by the axial forces applied.

The riveting sleeves according to the invention consist of deformable material which is selected in accordance with the respective case of application, for example the forces which occur. They can consist for example of steel, light metal, brass or another metal alloy, and even of deformable plastics material.

DETAILED DESCRIPTION OF PREFERRED EMBODIMENTS

Figure 1:
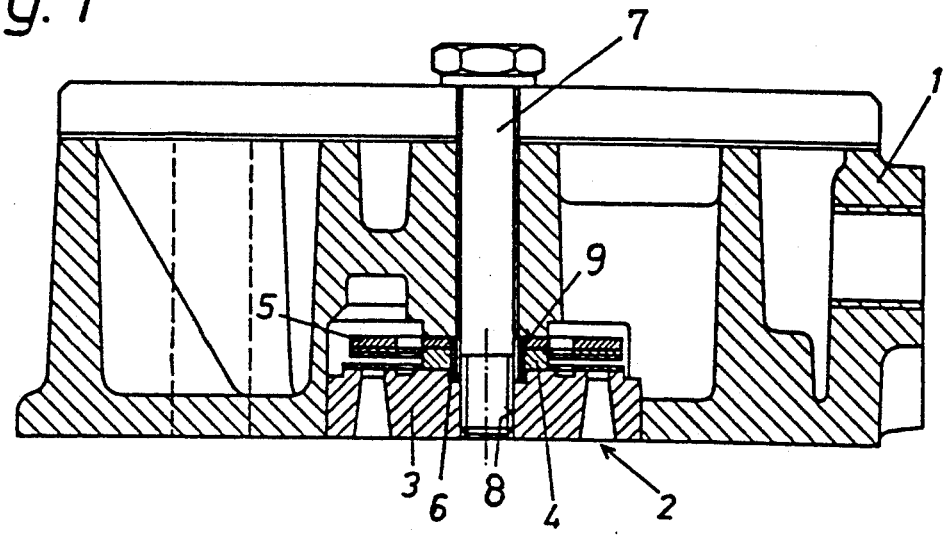
FIG. 1 is an axial median section of a compressor valve inserted in a cylinder head and having a riveting sleeve according to the invention.

The valve 2 inserted in a cylinder head 1 of a compressor as shown in FIG. 1 is a pressure valve and comprises a valve seating 3, a spacer 4 constructed as a guide ring and a buffer plate forming the catching means 5, additional valve parts being arranged between them. The valve parts are held together by a riveting sleeve 6 which is secured at one end in the valve seating 3, passes through the spacer 4 and the valve parts arranged around it and is anchored at its other end in the catching means 5. The riveting sleeve 6 has a tensioning bolt 7 passing through it, which is screwed into a thread 8 in the valve seating 3 and clamps the valve 2 against a seating face 9 in a recess in the cylinder head 1, into which the valve 2 is inserted or pressed.

Figure 2:
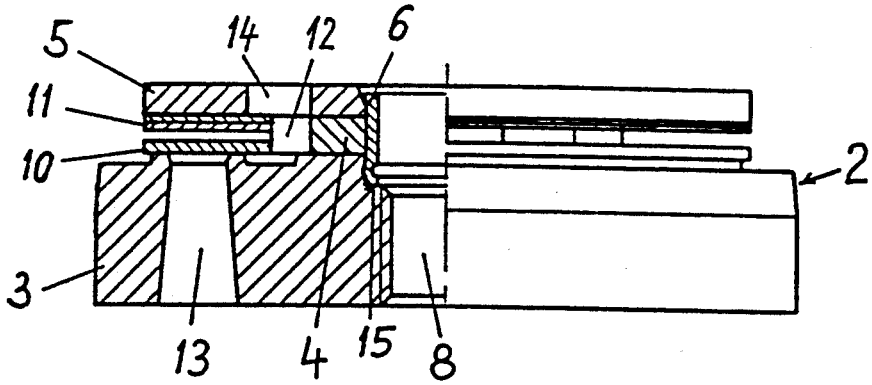
FIG. 2 is an enlarged illustration of the valve, partly in median section.

FIG. 2 is a partially cut-away illustration of the valve 2 removed from the cylinder head. An annular closure member 10 and a spring arrangement 11 comprising two spring rings are arranged between the valve seating 3 and the catching means 5, the closure member 10 and the spring arrangement 11 being guided in a sliding manner on radial extensions 12 of the spacer 4. The valve seating 3 is provided with through ducts 13 which are covered by the closure member 10. The catching means 5 has through slots 14. The threaded bore 8 provided in the valve seating 3 is widened in the upper part of the valve seating 3 so as to form a shoulder 15. The riveting sleeve 6 is secured in this widened part of the threaded bore 8.

Figure 3:
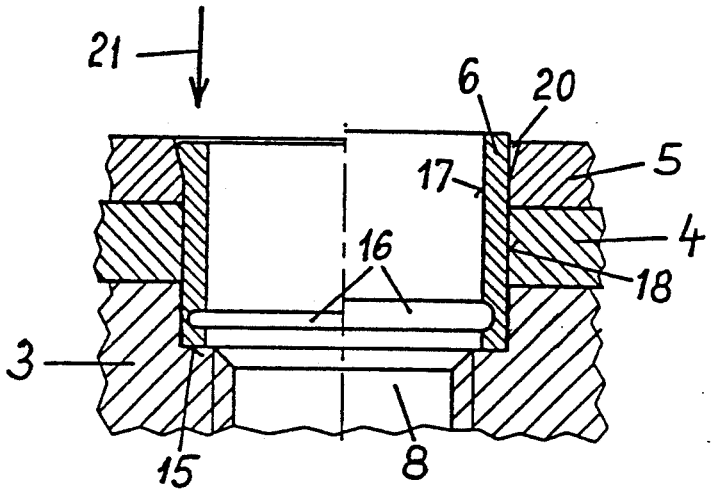
FIG. 3 is a further enlarged illustration of a detail.

The riveting sleeve 6 together with the valve parts surrounding it is shown on an enlarged scale in FIG. 3. The right-hand half of FIG. 3 shows the riveting sleeve 6 before riveting, whereas the finished rivet connexion may be seen in the left-hand half. The riveting sleeve 6 is inserted in the widened threaded bore 8 and rests with its lower end on the shoulder 15. In the region of this end it is provided with a groove 16 which starts from the inner generated surface 17 of the riveting sleeve 6 and extends radially outwards. The outer generated surface 18 of the riveting sleeve 6 rests against a cylindrical wall of the valve seating 3. At the upper end of the riveting sleeve 6 the offset threaded bore 8 is provided with a funnel-shaped widening 20.

If an axial force is exerted upon the riveting sleeve 6 in the direction of the arrow 21 indicated in the left-hand half of FIG. 3, this results in an upsetting of the riveting sleeve 6. The groove 16 is pushed together, as shown in the left-hand half of FIG. 3, with the result that the outer wall of the riveting sleeve 6 is widened radially outwards in the region of the groove 16, is pressed against the wall—surrounding it—of the shouldered bore 8 in the valve seating 3 and thus clamps the riveting sleeve 6 in the valve seating 3. With a further application of axial force the upper end of the riveting sleeve 6 is enlarged and deformed radially outwards into the funnel-shaped widening 20. It is also possible, however, for the upper end of the riveting sleeve 6 to be provided with merely a smooth bore without a widening in the catching means 5.

On account of the clamping and axial upsetting of the riveting sleeve 6, a precisely defined, firm and play-free connection is produced between the individual component parts of the valve, this connection being substantially free of tolerances. On account of the radial enlargement on the external diameter of the riveting sleeve 6 an additional centring and strengthening is achieved. Since the required upsetting force is relatively small, the thread in the threaded bore 8 is not deformed or damaged in any way. The valve can therefore be preassembled with the aid of the riveting sleeve 6 at the manufacturing plant and can be made safe for storage and for transport. It is merely necessary for the producer of the compressor to insert the ready-assembled valve in the cylinder head and to secure it by one or more tensioning bolts 7 as shown in FIG. 1.

Figure 4:
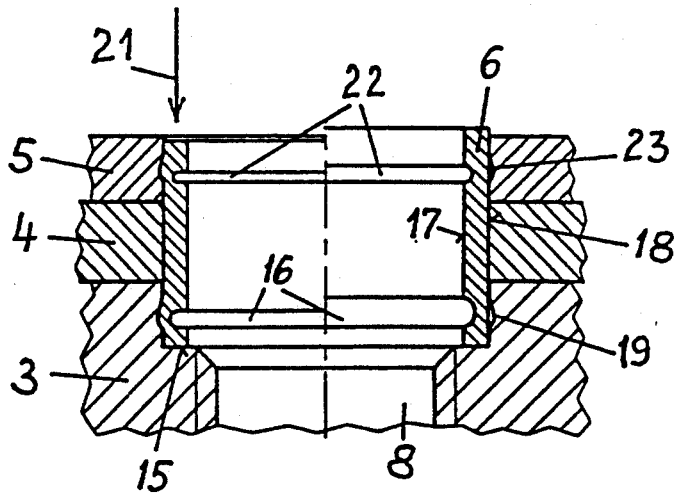
FIG. 4 is a variant of the riveting sleeve according to the invention in an enlarged digrammatic illustration.

FIG. 4 shows a variant of the riveting sleeve 6 illustrated in FIG. 3. Here too the riveting sleeve 6 rests with its lower end on the shoulder 15 of the widened threaded bore 8 and is connected to the valve seating 3 by the deformation produced with the aid of a groove 16. In contrast to the embodiment according to FIG. 3, however, in accordance with FIG. 4 a recess 19 opposite the groove 16 is provided in the wall of the valve seating 3 in the region of the groove 16. In addition, a further groove 22, which is opposite a recess 23 in the catching means 5 on the outer generated surface 18, is provided in the vicinity of the upper end of the riveting sleeve 6.

It may be seen from the right-hand half of FIG. 4 that the groove 22 is narrower and less deep than the groove 16 at the other end of the riveting sleeve 6. The result of this is that the remaining wall thickness of the riveting sleeve 6 in the region of the groove 16 is smaller than in the region of the groove 22. When the upsetting force required for riveting is applied in the direction of the arrow 21 the riveting sleeve 6 is therefore first deformed in the region of the groove 16, until the bead formed thereby has filled the recess 19 in the valve seating 3. Only then is the riveting sleeve 6 also deformed in the region of the groove 22 with the further application of the upsetting force, the recess 23 in the catching means 5 being filled. If the connexion between the catching means 5 and the riveting sleeve 6 need be capable of bearing only slight loads in the axial direction, the recess 23 can also be dispensed with and the connexion can be produced by clamping only.

With this embodiment, therefore, a firm, play-free and secure connection of the valve parts can also be achieved by merely applying an axial force to the riveting sleeve 6. It is evident from the embodiment according to FIG. 4 that more than two grooves can be arranged in the riveting sleeve 6. In this way, a further groove can be provided in the region of the spacer 4, with an associated recess in the spacer 4, as a result of which the latter would also be directly connected to the riveting sleeve 6 during the upsetting thereof.

By choosing the width and depth of the individual grooves, the sequence of the deformation—occurring during the upsetting—of the areas of the riveting sleeve 6 provided with grooves can be selected in accordance with the respective requirements. Since the riveting sleeve 6 is deformed outwards by forming a bead in the case of the embodiment according to FIG. 4, there is practically no reduction in the internal diameter of the riveting sleeve 6, so that a centring mandrel used in each case during the upsetting can be withdrawn from the riveting sleeve with relatively little force and without difficulty after deformation of the said riveting sleeve.

The embodiments show that the riveting sleeve 6 can be deformed optionally outwards or inwards by merely applying an axial force without special tools, depending upon whether the grooves provided in the riveting sleeve start from the inner generated surface or the outer generated surface thereof. In addition, in the case of a plurality of grooves in the same riveting sleeve the sequence of the deformation occurring can be determined optionally by the depth and width of the grooves.

What is claimed and desired to be secured by Letters Patent is:

1. A valve, in particular for compressors, adapted to be inserted into or attached to a housing and to be clamped by at least one tensioning bolt against the seating face of the housing, the valve being composed of a number of valve parts arranged one on top of the other and comprising:

a valve seating with through-ducts;

at least one closure member arranged movably above the valve seating;

a catching means for the closure member;

at least one spacer between the valve seating and the catching means; and a most extremely arranged valve part, wherein the valve parts are held securely on the valve seating or the catching means by at least one clamping sleeve acting as a transportation safeguard and assembly aid in addition to the at least one tensioning bolt and before insertion or attachment of the valve into or to the housing, the sleeve comprising at least one groove which starts from an inner generated surface of the sleeve and which extends around the periphery of the sleeve, as a result of which the sleeve is deformable outwards in the region of said at least one groove by a force exerted upon it in an axial direction, and the clamping sleeve is connected by clamping to the most extremely arranged valve part, in particular to the valve seating and the catching means, and wherein the valve parts arranged between the extremely arranged valve part and the valve seating are fitted on the sleeve in the correct insertion position and the sleeve ends inside the outer face of the valve parts.

2. A valve according to claim 1, wherein a recess is provided in the valve part adjacent to the clamping sleeve in the region of at least one groove on the side of the generated surface of the clamping sleeve opposite the groove.

3. A valve according to claim 1, wherein a groove starting from the inner generated surface of the clamping sleeve is provided in the region of one end of the clamping sleeve and the valve part adjacent to the outside of the clamping sleeve is widened into a funnel shape at the other end of said clamping sleeve.

4. A valve according to claim 1, wherein grooves are provided in the region of the two ends of the clamping sleeve.

5. A valve according to claim 1, wherein in the case of a clamping sleeve with more than one groove the grooves are of unequal depth, unequal width, or both unequal depth and unequal width.

6. A valve according to claim 5, wherein the depth or width of the grooves is smallest at that end of the clamping sleeve to which the axial force for clamping is applied, and increases stepwise towards the other end of the clamping sleeve.

7. A valve according to claim 1, adapted to be used in a reciprocating compressor having a cylinder head wherein a tensioning bolt anchored in the cylinder head of the compressor, passes through at least one of the clamping sleeves in order to fasten the valve.

* * * * *